US005921662A

United States Patent [19]

Bruckner et al.

[11] Patent Number: 5,921,662

[45] Date of Patent: Jul. 13, 1999

[54] ADAPTER FOR GENERAL-DIFFUSE MINIATURE REFLECTORS

[76] Inventors: Attila Anton Bruckner, Eichenweg 5, D-65582 Hambach; Gerd Schröter, Basaltring 21, D-65582 Diez, both of Germany

[21] Appl. No.: 08/817,871

[22] PCT Filed: Oct. 24, 1995

[86] PCT No.: PCT/EP95/04169

§ 371 Date: May 6, 1997

§ 102(e) Date: May 6, 1997

[87] PCT Pub. No.: WO96/31732

PCT Pub. Date: Oct. 10, 1996

[30] Foreign Application Priority Data

Apr. 2, 1995 [DE] Germany ..... 295 05 546 U

[51] Int. Cl.[6] ..... F21V 13/10

[52] U.S. Cl. ..... 362/292; 362/354; 362/440; 362/442

[58] Field of Search ..... 362/282, 283, 362/290–292, 297, 298, 301–306, 342, 354, 438–440, 442–445, 18, 459, 487, 496

[56] References Cited

U.S. PATENT DOCUMENTS

| | | | |
|---|---|---|---|
| 921,449 | 5/1909 | Penney | 362/290 |
| 1,562,186 | 11/1925 | Powell et al. | 362/302 |
| 2,021,790 | 11/1935 | Kuhn | 362/290 |
| 2,437,522 | 3/1948 | Handler | 362/354 |
| 4,833,579 | 5/1989 | Skegin | 362/362 |
| 4,899,263 | 2/1990 | Lupoli et al. | 362/80 |
| 5,249,111 | 9/1993 | Richardson | 362/302 |

FOREIGN PATENT DOCUMENTS

| | | | |
|---|---|---|---|
| 166019 | 7/1921 | United Kingdom | 362/292 |
| 173730 | 8/1922 | United Kingdom | 362/290 |
| 2 028 482 | 3/1980 | United Kingdom . | |
| 91 17 387 | 11/1991 | WIPO . | |

*Primary Examiner*—Alan Cariaso
*Attorney, Agent, or Firm*—Herbert Dubno

[57] ABSTRACT

A one-piece attachment for a general-diffuse miniature reflector has either the lamellae resting upon the rim of the reflector and engaging behind it with formations on the lamellae, or a support ring with handle like elements engaging the rim form behind, the lamellae or blades being connected by trips with the ring so that the lamellae are all integral and in one piece with one another.

11 Claims, 3 Drawing Sheets

ADAPTER FOR GENERAL-DIFFUSE MINIATURE REFLECTORS

CROSS REFERENCE TO RELATED APPLICATIONS

This application is a national stage of PCT/EP95/041169 filed Oct. 24, 1995 and based upon German application 295 05 546.4 filed Apr. 2, 1995 under the International Convention.

FIELD OF THE INVENTION

The invention relates to an attachment for general-diffuse miniature reflectors which contain an illuminating means. The miniature reflector and the illuminating means form an integral unit. The reflector diameter spans a few centimeters. The illuminating means is usually a low-voltage halogen lamp. At its reaar the reflector has a socket with connection elements to a lamp mount, for instance in the form of a plug-in connection.

BACKGROUND OF THE INVENTION

Miniature reflectors of the described kind are used for home lighting, and commercially for the illumination of product displays, store windows and the like also as so-called general-diffuse reflectors, i.e. without an external housing. The attachment to which the invention relates is meant to limit the light emission, so that glare can be avoided, to mask certain areas for design purposes, and the like.

Light-guiding attachments for lamps are known. Within the known framework it is possible to work with attachment holders wherein filter screens, lenses, grids, foils, rasters, flaps and diaphragms can be inserted as desired. The known attachment holders can be fastened to the housing of lamps, are made of several parts and their construction is costly. As a rule they are used only in professional and semiprofessional lamps. The known attachments are not suitable for use on the general-diffuse miniature reflectors.

OBJECTS OF THE INVENTION

It is the object of the invention to provide an attachment for general-diffuse miniature reflectors which can be mounted directly to the miniature reflector and can be easily exchanged.

SUMMARY OF THE INVENTION

The object of the invention and the solution to the problem is an attachment which is characterized by

- a support element resting on the reflector rim,
- at least two clamping elements integrally formed on the support element and engaging behind the reflector rim, and
- at least one light-deflecting element integrally formed on the support element, for influencing the emergence of light from the miniature reflector.

The support element, the clamping elements and the light-deflecting element are components of an integral attachment element formed in one piece. The attachment is made of a temperature resistant, non-elastic but flexible material and is held by its clamping element in a positive lock on the reflector rim. All functional elements (holding clamps, hinges, lamellae, flaps) are formed from the component itself. Preferably the attachment is made of stainless spring steel sheet as a stamped and bent part and provided with a dull black surface coating.

The attachment of the invention can be produced with a very low weight, so that the usual connections between the miniature reflector and the lamp socket can easily take up the additional weight. As a rule the weight of the attachment is always lower than the weight of the reflector with illuminating means.

The attachment of the invention is cost effective, functionally safe and easy to handle. It can be mounted and removed without special skills and without tools. The cleaning is simple. The low cost has a positive effect when it is purchased, as well as when it is damaged or lost. The attachment of the invention is also suitable for an easy retrofitting of general-diffuse miniature reflectors.

According to a preferred embodiment, the support element is a support ring on which angularly bent-off clamping elements are integrally formed. Suitably the clamping elements are shaped as handles engaging behind a ring segment of the reflector rim. A particularly simple and secure engagement results especially then when the handles are curved and at their connection strips are provided with projections pointing towards the underside of the reflector rim.

There are many design possibilities regarding the light-deflection elements. Of particular importance are light flaps for the masking of certain areas for reasons of design, as well as light-deflecting lamellae for glare avoidance. In a further development the invention teaches that at least two light flaps are connected by bendable strips to the support ring or that light-deflecting lamellae are connected to the support ring, whereby the light-deflecting lamellae are connected with the support ring by strips and are perpendicularly bent off with respect to the support surface. Two or more parallel light-deflecting elements can be provided. Alternately it is further possible at least three light-deflecting elements can be arranged radially, whereby the light deflecting elements are centrally connected to form one piece for instance by connection disks.

A particularly preferred embodiment of the invention has two light flaps arranged at opposite peripheral segments of the support ring. The clamping elements are positioned on the circumference of the support ring at a right angle thereto. Each light flap can be connected by two bendable strips with the support ring, whereby the distance between the strips is bigger than the width of the clamping elements, thereby allowing the mounting of a wider attachment, whose clamping elements which are identical to the ones of the first attachment, can be inserted in the free space between the strips and engage behind the reflector rim. Multiple combinations are possible. Particularly it is possible to combine with each other attachment elements with light flaps, as well as attachment elements with light flaps and light-deflecting lamellae.

The aforedescribed embodiments always have a support ring as a support element. However the ring-shaped design of the support element is not mandatory. An alternative embodiment of the invention provides light-deflecting lamellae which are interconnected as an integral piece by at least one strip and rest on the reflector rim with their lamellae ends pointing towards the outside of the reflector, whereby on the lamellae ends holding projections are formed which engage behind the reflector rim.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
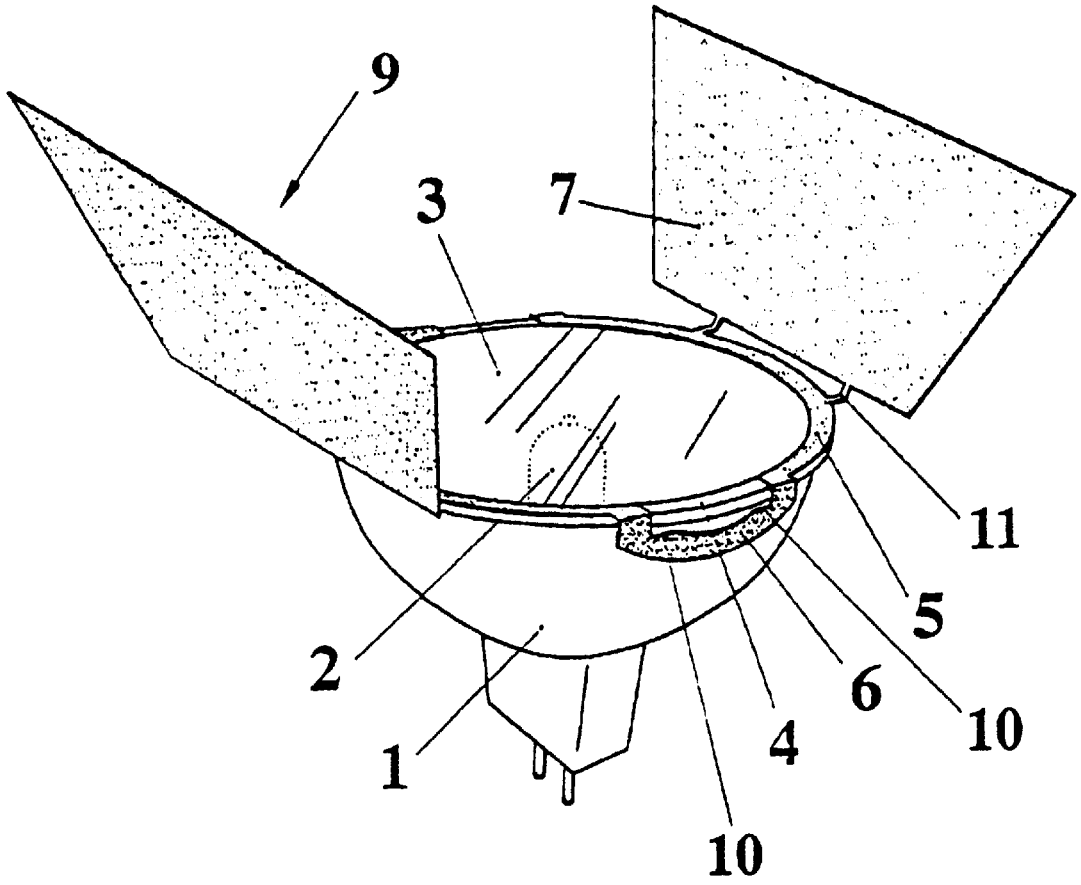
FIG. 1 is a perspective view of an attachment for a general-diffuse miniature flaps.

The figures show light-deflecting attachments which are respectively mounted on a miniature reflector 1 with illuminating means 2, integrated cover 3 and a rim 4. The attachments each have a support element 5 resting on the reflector rim 4 of the miniature reflector 1, at least two clamping elements 6 integrally formed on the support element 5 engaging behind the reflector rim 4, and at least one light-deflecting element 7, 8 integrally formed on the support element 5 for influencing the emergence of light from the minireflector 1. The support element 5, the clamping elements 6 and the light-deflecting elements 7, 8 forming the integral attachment element 9 are made in one piece. The attachment elements 9 are one-piece stamped and bent parts which in the embodiment example are made of a stainless spring steel sheet and have a dull black surface.

Figure 2:
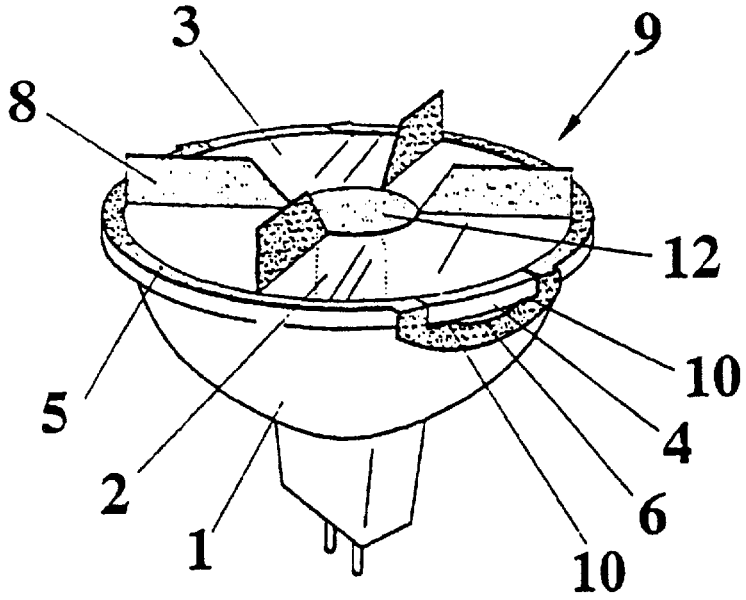
FIG. 2 is a perspective view of an attachment with radial light-deflecting lamellae.
Figure 3:
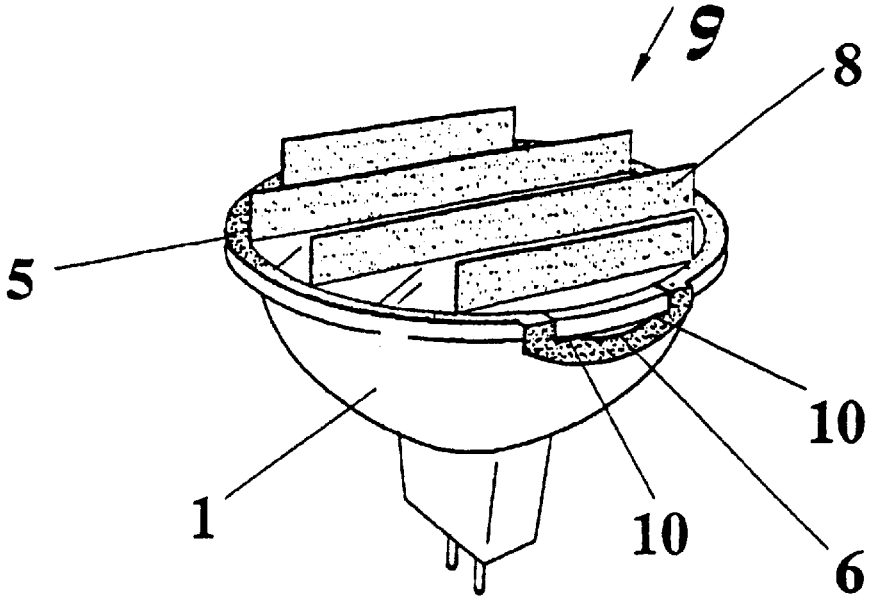
FIG. 3 is a perspective view of an attachment with parallel light-deflecting lamellae.

FIGS. 1 to 3, show that the support element 5 is a support ring on which angularly bent-off clamping elements 6 are integrally formed. The clamping elements 6 are designed as handles, each of them engaging behind a ring segment of the reflector rim 4, thereby positively locking the attachment element 9 to the reflector rim 4. It can also be seen that the handles are curved and close to their connection strips have projections 10 turned towards the underside of the reflector rim 4.

The light-deflecting elements can be of various design. FIG. 1 shows an embodiment with two lateral light flaps 7, which are connected to the support ring 5 by strips 11. The strips 11 are bendable and function as bending hinges.

FIGS. 2 and 3 relate to attachment elements 9 with light-deflecting lamellae 8. The light-deflecting elements 8 are connected by strips to the support ring 5 and are perpendicularly bent off with respect to the support surface. Thereby three or more light-deflecting lamellae can be provided in a radial arrangement, whereby the light-deflecting lamellae are centrally connected by an integral connection disk 12 (FIG. 2). FIG. 3 shows an embodiment with parallel light-deflecting lamellae 8, which form a parallel raster.

Figure 4:
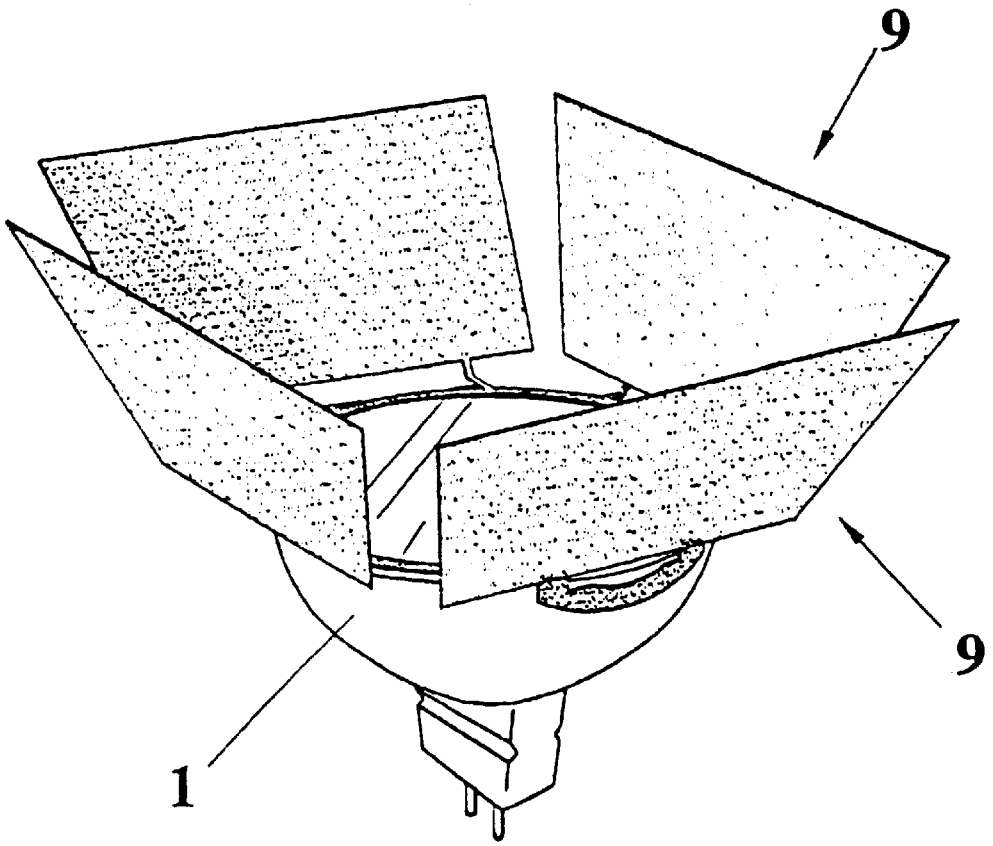
FIG. 4 is a perspective view of the combination of two attachments each having two light flaps fitted on a miniature reflector.
Figure 5:
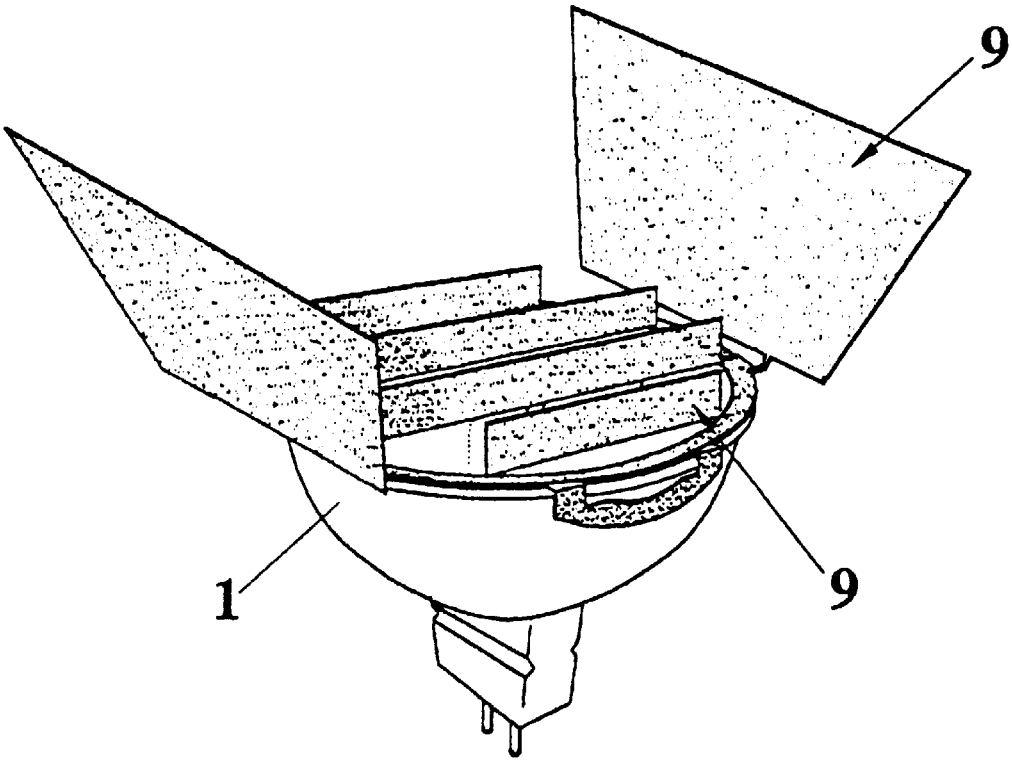
FIG. 5 is a perspective view of the combination of an attachment with light-deflecting lamellae and an attachment with lateral light flaps.

From FIGS. 4 and 5 it can be seen that the attachment elements 9 with lateral side flaps can be combined with each other, as well as with an attachment element having light-deflecting lamellae 8. The combination of two attachment elements is possible when the distance between the strips of the light flaps 7 is greater than the width of the clamping elements 6. In way a wider attachment can be fitted, in that the clamping elements 6 of this attachment are inserted in the free space between the strips 11 and then engage behind the reflector rim 4.

Figure 6:
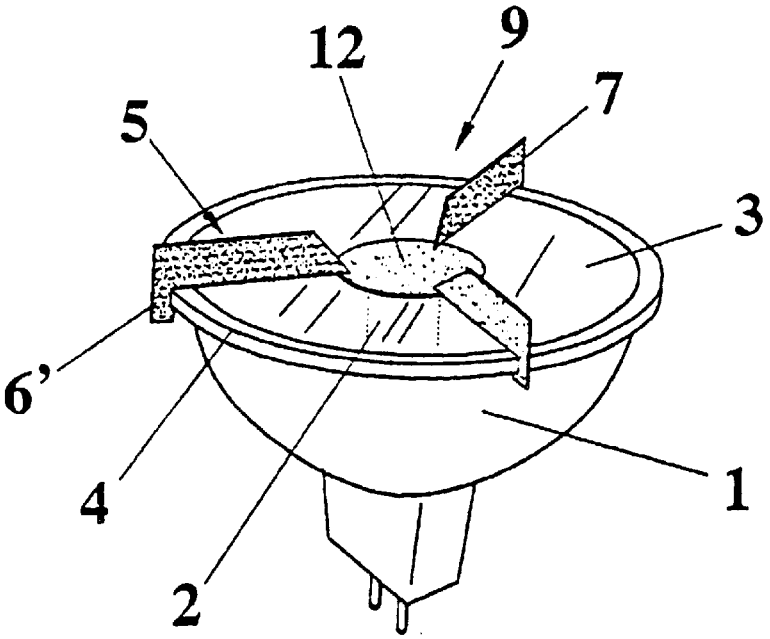
FIG. 6 is a perspective view of another attachment for another constructive design of an attachment for a general-diffuse miniature reflector.

In the embodiment shown in FIG. 6, the attachment element 9 has light-deflecting lamellae 8 which are interconnected to form one piece by at least one web, e.g. in the form of a connection disk 12 and rest with their lamellae ends on the outside of the reflector on the reflector rim. The lamellae ends form the support element 5. On the lamellae ends holding projections 13 are integrally formed, which engage behind the reflector rim 4 and positively lock the attachment element 9 on the reflector rim 4.

We claim:

1. A lamp assembly comprising:

a miniature reflector having a reflector rim surrounding an opening through which light emerges, and a one-piece integral attachment mounted on said reflector and comprising:

a support ring resting on said reflector rim;

at least two clamping elements integrally formed on said support ring and formed as respective bent-off portions of said support ring engaging behind the reflector rim; and at least two light-deflecting flaps integrally formed on said support ring and each connected with said support ring by two bendable strips, said flaps influencing emergence of light from said reflector.

2. The lamp assembly defined in claim 1 wherein said clamping elements are configured as handles which engage behind respective ring segments of said rim.

3. The lamp assembly defined in claim 2 wherein said handles are curved and have connection strips connecting said handles wits said ring, said handles having projections in the direction of an underside of said rim close to said connection strips.

4. The lamp assembly defined in claim 1 wherein said flaps form parallel light-deflecting lamellae.

5. The lamp assembly defined in claim 1 wherein said strips are so spaced that said elements of another ring and another attachment can fit between said strips to engage behind said rim.

6. A lamp assembly comprising:

a miniature reflector having a reflector rim surrounding an opening through which light emerges, and a one-piece integral attachment counted on said reflector and comprising:

a support ring resting on said reflector rim;

at least two clamping elements integrally formed on said support ring and formed as respective bent-off portions of said support ring engaging behind the reflector rim; and at least one light-deflecting element integrally formed on said support ring and influencing emergence of light from said reflector, said clamping elements being configured as handles which engage behind respective ring segments of said rim, said handles being curved and having connection strips connecting said handles with said ring, said handles having projections in the direction of an underside of said rim close to said connection strips.

7. The lamp assembly defined in claim 6 wherein said light-deflecting element is formed by a plurality of light-deflecting lamellae connected to said ring by strips and bent at a right angle to a plane of said ring.

8. The lamp assembly defined in claim 7 at least two parallel light-deflecting lamellae are provided.

9. The lamp assembly defined in claim 7 wherein at least three light-deflecting lamellae are provided in a radial arrangement and are centrally interconnected by a connection disk.

10. The lamp assembly defined in claim 7 wherein said strips are so spaced that said elements of another ring of another attachment can fit between said strips to engage behind said rim.

11. A lamp assembly comprising:

a miniature reflector having a reflector rim surrounding an opening through which light emerges, and a one-piece integral attachment mounted on said reflector and comprising:

a plurality of lamellae extending across said opening and transverse to a plane of said rim for influencing emergence of light from said reflector;

means for interconnecting said lamellae in one piece, said lamellae resting upon said rim; and holding projections integrally formed on said lamellae and engaging behind said rim.

* * * * *